US005743470A

United States Patent [19]

Schlaf et al.

[11] Patent Number: 5,743,470

[45] Date of Patent: Apr. 28, 1998

[54] FUEL INJECTION VALVE FOR INTERNAL COMBUSTION ENGINES

[75] Inventors: Siegfried Schlaf, Weil Der Stadt/Merklingen; Friedrich Boecking, Stuttgart, both of Germany

[73] Assignee: Robert Bosch GmbH, Stuttgart, Germany

[21] Appl. No.: 770,099

[22] Filed: Dec. 19, 1996

[30] Foreign Application Priority Data

Dec. 19, 1995 [DE] Germany ..... 195 47 423.6

[51] Int. Cl.[6] ..... F02M 45/00; F02M 61/06

[52] U.S. Cl. ..... 239/533.4; 239/533.9; 239/585.5

[58] Field of Search ..... 239/533.4, 533.12, 239/585.5

[56] References Cited

U.S. PATENT DOCUMENTS

| | | | |
|---|---|---|---|
| 4,139,158 | 2/1979 | Uchida | 239/533.12 |
| 4,365,746 | 12/1982 | Tanasawa et al. | 239/585.5 X |
| 4,524,914 | 6/1985 | Kaibara et al. | 239/533.12 X |
| 5,163,621 | 11/1992 | Kato et al. | 239/533.12 |
| 5,211,340 | 5/1993 | Yoshizu | 239/533.9 X |

FOREIGN PATENT DOCUMENTS

| | | | |
|---|---|---|---|
| 3237882 | 4/1984 | Germany | 239/533.12 |
| 4303813 | 6/1994 | Germany . | |

*Primary Examiner*—Kevin Weldon

*Attorney, Agent, or Firm*—Edwin E. Greigg; Ronald E. Greigg

[57] ABSTRACT

A fuel injection valve for internal combustion engines includes a valve member, which is axially displaceable in a bore of a valve body and which on its end toward the combustion chamber of the engine has a conical valve sealing face. The conical valve sealing faced cooperates with a conical valve seat face on the closed end of the bore of the valve body toward the combustion chamber. Between the cone angles of the valve sealing face and the valve seat face, a seat angle difference is provided, by which an encompassing seat edge is formed between the valve member and the valve body, and having at least one injection port in the region of the valve seat phase adjoins the seat edge downstream thereof. For a reliable, defined line of contact on the sealing edge formed by the seat edge, the annular gap adjoining the seat edge downstream thereof, between the valve seat face and the valve sealing face of the valve member is enlarged by an encompassing radial recess between the seat edge and the inlet opening of the injection port.

12 Claims, 1 Drawing Sheet

FUEL INJECTION VALVE FOR INTERNAL COMBUSTION ENGINES

BACKGROUND OF THE INVENTION

The invention is based on a fuel injection valve for internal combustion engines. In one such by fuel injection valve, known from German Patent 43 03 813; U.S. Pat. No. 5,465,907, a pistonlike valve member is guided axially displaceably in the valve bore of a valve body. The valve member, on its end toward the combustion chamber, has a conical valve sealing face, with which it cooperates with a conical valve seat face on the valve body, the valve seat face is formed on the inward-projecting end of the closed valve bore. As a result of the seat angle difference between the conical valve sealing face and the seat face, an encompassing seat edge on the valve member is formed, which when the injection valve is closed seals off a pressure chamber that is adjacent to the seat edge upstream. Downstream of this seat edge, at least one injection port, that discharge into the combustion chamber of the engine to be supplied, is provided in the wall of the valve body, leading away from the valve seat face. In the known fuel injection valve of the so-called "seat port nozzle" type, the seat angle difference provided between the valve sealing face of the valve member and the seat face on the valve body has only a small value (approximately 0.15° to 1.25°), which can mean that if there are irregularities in the surfaces of the valve body and/or the valve member in the seat region, the valve member will not effect exact sealing at the diameter of the encompassing seat edge but rather will do so at a random line of contact between the valve member and the valve body. This kind of contact and thus the hydraulic pressure engagement area effective in the opening direction on the conical valve member face, which area jointly determines the opening pressure of the injection valve, can now vary as a function of the rotated position of the valve member, at a constant restoring force of the valve spring. From this change in the line of contact caused by the random nature of the surface of the valve body and the valve member in the seat region, a change in the opening pressure of the injection valve is brought about, which may be greater than the allowable adjustment tolerance. This means increased production costs and considerable readjustment work, and this disadvantage is even greater when a two-stage restoring force is used, or in other words in injection valves that have a preinjection and a main injection.

OBJECT AND SUMMARY OF THE INVENTION

The fuel injection valve according to the invention for internal combustion engines has the advantage over the prior art that in every rotary position of the valve member, and despite surface unevenness of the seat faces, a defined line of contact (sealing line) within the tolerance range exists at the seat edge between the valve seat face and the valve member. Compared with the known fuel injection valves, on rotation of the valve member markedly smaller differences in the hydraulically effective seat diameter occur. Moreover, the deviation in the hydraulically effective seat diameters, in mass production, is within a substantially smaller range.

The reliable, defined line of contact at the seat edge is advantageously attained by means of an encompassing radial recess, which adjoins the seat edge directly downstream of it, and which can be machined alternatively in either the valve sealing face of the valve member or the seat face of the valve body. By means of this recess, contact of the valve member and the valve body, except at the sealing seat in the region of the seat edge, is reliably precluded, since the spacing between the valve member and the valve body below the recess in the direction of the injection port is markedly greater than any possible surface unevenness would be. This effect is advantageously reinforced by the larger seat angle difference compared with the prior art, which is now up to 5°.

Because of the greater spacing between the valve member and the valve body in the critical region, the expense for readjustment of the opening pressure of the injection valve can now be reduced considerably. This adjustment process can now be done, instead of a hydraulic adjusting process, with a force adjusting process (for example with piezoelectric force pickups), so that the adjustment process is simple to automate. Moreover, this kind of force adjustment of the opening pressure of the injection valve has the advantage that the adjusting process is oil-free, which considerably lessens the expense.

The recess is advantageously in the form of an annular groove of curved cross section, so that the greatest spacing from the opposing wall face is in the middle region. The radii of the curvature are preferably in a range from approximately 0.2 to 0.8 mm, and the maximum spacing between the recess and the opposed wall face is preferably from 0.01 to 0.06 mm. The cross-sectional transition between the seat edge and the recess, or between the seat face and the recess, may be embodied with sharp edges or may have a radius (preferably 0.1 to 0.8 mm).

To avoid influencing the sealing off of the injection port and thus a return flow of combustion gases into the valve interior, the radial recess does not extend as far as the inlet opening directly of the injection port, but instead is separated from that by a slight remaining web region.

The use of the recess and thus the precisely defined sealing or seat edge has an especially advantageous effect in injection valves with a two-stage opening stroke, because there the abovedescribed disadvantages of the known fuel injection valve have an especially strong effect on the flow characteristic at the injection valve.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
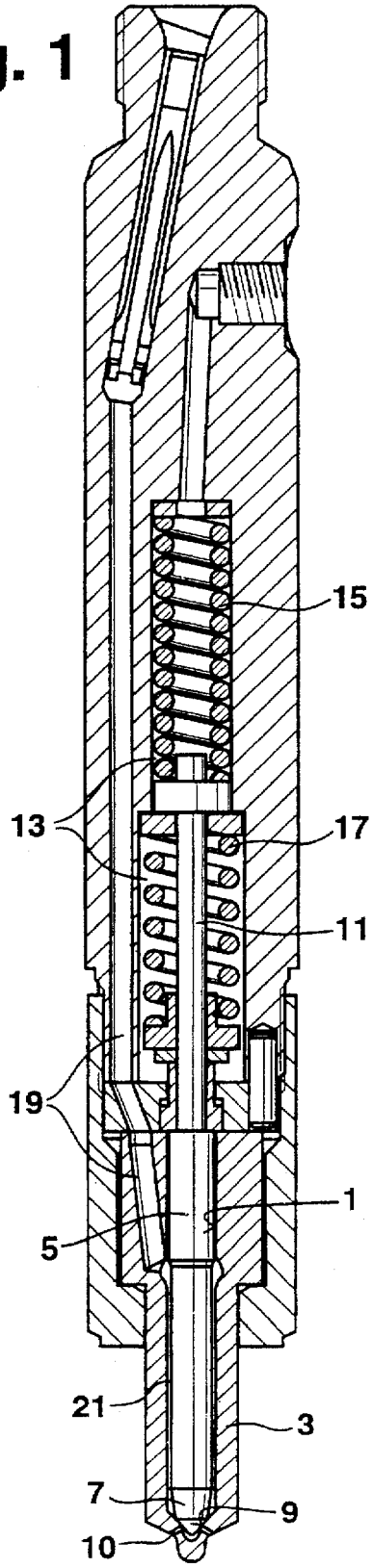
FIG. 1 is a longitudinal section through the injection valve.
Figure 2:
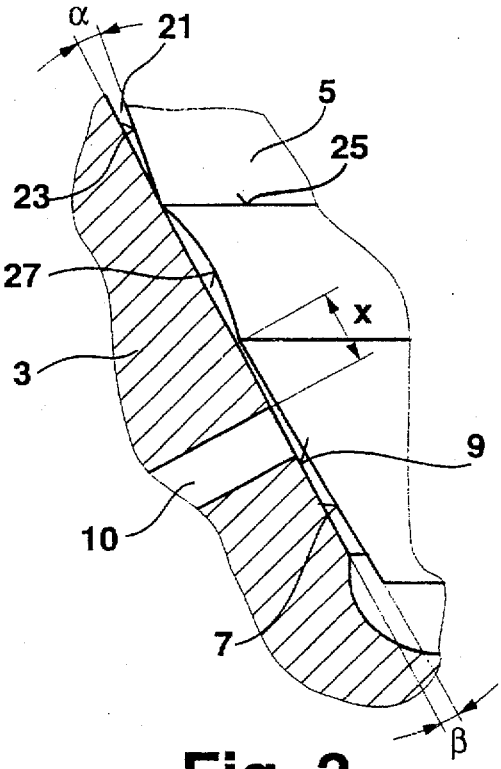
FIG. 2 shows a first exemplary embodiment in an enlarged detail of FIG. 1, in which the radial recess is provided in the valve sealing face of the valve member.
Figure 3:
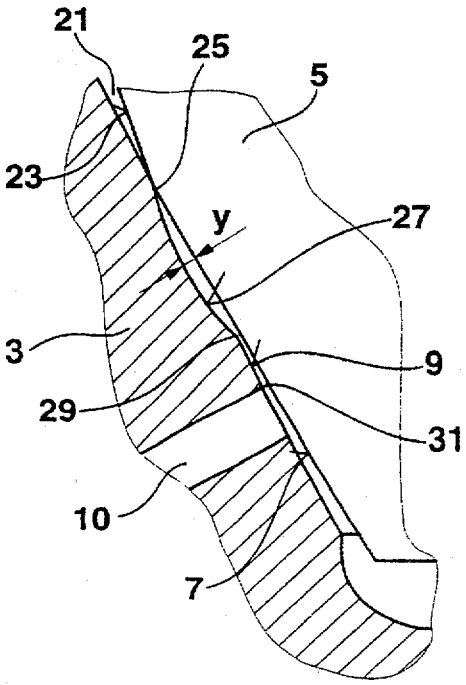
FIG. 3 shows a second exemplary embodiment, analogous to the view of FIG. 2, in which the radial recess is machined into the wall of the seat face on the valve body.

The fuel injection valve shown in section in FIG. 1 for internal combustion engines has a valve member 5, axially guided in a bore 1 of a valve body 3, that on an end that protrudes into the combustion chamber of the engine (not shown) has a conical valve sealing face 7, with which it cooperates with a conical valve seat face 9 on the closed end of the bore 1 of the valve body 3, from which an injection port 10 leads into the combustion chamber of the engine to be supplied; for the more detailed embodiment of the valve seat region, reference is also made to FIGS. 2 and 3, whose description follows.

On its end remote from the valve seat 9, the valve member 5 protrudes past a pressure piece 11 into a spring chamber 13, into which two valve springs are inserted, disposed one after another and urges the valve member 5 in the closing direction toward the valve seat 9 of these springs, a first valve spring 15 rests constantly on the valve member 5, while conversely the second valve spring 17 does not engage the valve member 5 until after a certain preliminary stroke has been executed, so that the opening stroke motion of the valve member 5 is subdivided, in the manner well known from the prior art, into a preliminary and a main injection phase. The supply of high-pressure fuel to the valve seat 9 is effected via a pressure line 19 in the injection valve, which discharges into a pressure chamber 21, formed between the shaft of the valve member 5 and the wall of the bore and extending as far as the valve seat 9.

The structure, which is essential to the invention, of the valve seat region of the injection valve will now be explained in terms of two exemplary embodiments, which are shown in FIGS. 2 and 3 in an enlarged detail of FIG. 1.

In both exemplary embodiments, between the cylindrical shaft of the valve member 5 and the conical valve sealing face 7, a likewise conical inflow face 23 is provided on the valve member 5; it has a smaller cone angle than the conical valve sealing face 7, so that at the transition between the inflow face 23 and the valve sealing face 7 an encompassing seat edge 25 is formed, which rests on the valve seat face 9 of the valve body 3, sealing off the pressure chamber 21 adjoining it upstream. The inflow angle $\alpha$ formed between the valve seat face 9 and the inflow face 23 is from about 45° to about 60° preferably approximately 55° (not shown).

For a good sealing seat, the cone angle of the conical valve seat face 9 and the cone angle of the valve sealing face 7 on the valve member 5 moreover have a seat angle difference $\beta$ of approximately 5°.

For a defined line of contact on the seat edge 25, an encompassing radial recess 27 is also provided, in the form of an annular groove that directly joins the seat 25 downstream thereof, and whose lower, downstream-pointing end 29 is spaced apart by a certain distance X from the upper, upstream-pointing end 31 of the inlet opening of the injection port 10. The recess 27 is curved, with a radius of between 0.2 and 0.8 mm; the greatest spacing from the opposed wall face is provided approximately in the middle region of the encompassing recess 27.

In the first exemplary embodiment, shown in FIG. 2, the recess 27 is provided in the wall of the valve sealing face 7 of the valve member 5; the cross-sectional transition at the seat edge 25 is embodied with a sharp edge. A transition by means of a radius is also possible. The maximum gap size in the middle region of the recess should be approximately 0.01 to 0.06 mm.

In the second exemplary embodiment, shown in FIG. 3, the recess 27 is disposed in a wall of the valve seat face 9, and once again adjoins the region of coincidence with the seat edge 25 directly downstream thereof. In the second exemplary embodiment as well, the largest gap size Y is provided in the middle of the recess 27. In FIG. 3 as well, an annular gap of slight diameter also remains between the lower edge 29 of the recess 27 and the upper peripheral edge 31 of the inlet opening of the injection port 10.

The fuel injection valve of the invention functions in a known manner, in that the high pressure of the fuel flowing into the pressure chamber 21 lifts the valve member 5 from the valve seat 9 counter to the restoring spring force, so that the injection cross section is opened up, and the fuel passes via the injection ports 10 into the combustion chamber of the engine. The opening stroke motion in the injection valve shown is subdivided by means of two valve springs 15, 17 into two phases, that come into action successively, so that initially only a small opening cross section is opened up, by way of which a preinjection quantity is injected, after the injection valve is acted upon by the second spring the full opening of the cross section occurs and the main injection quantity is injected into the cylinder.

Because of the provision according to the invention of a cross-sectional widening adjoining the seat edge 25 downstream, it is reliably assured that the sealing edge formed at the seat edge 25 always has a defined, predetermined course of the line of contact, even if surface unevenness exists in the valve seat face 9 and/or the valve sealing face 7.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection valve for internal combustion engines, having a valve member (5), which is axially displaceable in a bore (1) of a valve body (3) and on an end toward the combustion chamber of the engine has a conical valve sealing face (7), with which the valve sealing face cooperates with a conical valve seat face (9) on the closed end of the bore (1) of the valve body (3) toward the combustion chamber, and between the cone angles of the valve sealing face (7) and the valve seat face (9) a seat angle difference is provided, by which an encompassing seat edge (25) is formed between the valve member (5) and the valve body (3), and having at least one injection port in the region of the valve seat phase (9) adjoining the seat edge (25) downstream thereof, the annular gap adjoining the seat edge (25) downstream thereof, between the valve seat face (9) and the valve sealing face (7) of the valve member (5), is enlarged by an encompassing radial recess (27) between the seat edge (25) and the inlet opening of the injection port (10).

2. A fuel injection valve in accordance with claim 1, in which the encompassing radial recess (27) is provided in the wall of the valve sealing face (7) of the valve member (5).

3. A fuel injection valve in accordance with claim 1, in which the encompassing radial recess (27) is provided in the wall of the valve seat face (9) of the valve body (3).

4. A fuel injection valve in accordance with claim 1, in which the radial recess (27) directly adjoins the seat edge (25).

5. A fuel injection valve in accordance with claim 1, in which when the valve member (5) is contacting the valve seat (9), a lower, downstream-pointing end (29) of the radial recess (27) is spaced apart by a minimum distance (X) from the upper, upstream-pointing end (31) of the inlet opening of the injection port (10), so that an annular gap region with a small gap size remains between the radial recess (27) and the injection port (10).

6. A fuel injection valve in accordance with claim 1, in which the radial recess (27) is embodied as an annular groove.

7. A fuel injection valve in accordance with claim 6, in which the cross-sectional transition formed between the seat edge (25) and the recess (27) is embodied as sharp-edged.

8. A fuel injection valve in accordance with claim 6, in which the cross-sectional transition formed between the seat edge (25) and the recess (27) has a radius.

9. A fuel injection valve in accordance with claim 6, in which the annular-groovelike recess (27) has a curved cross-sectional shape, whose middle maximum spacing (Y) from the opposed wall face is approximately 0.01 to 0.06 mm.

10. A fuel injection valve in accordance with claim 1, in which the seat angle difference (β) formed between the conical valve seat face (9) and the conical valve sealing face (7) on the valve member (5) is a maximum of 5°.

11. A fuel injection valve in accordance with claim 1, in which the valve member (5) upstream of the valve sealing face (7), a conical inflow face (23) is provided, whose cone angle is smaller than the cone angle of the conical valve sealing face (7), and at the transition between the inflow face (23) and the valve sealing face (7) the seat edge (25) is formed on the valve member (5), and that the inflow angle (α) between the inflow face (23) of the valve member (5) and the valve seat face (9) on the valve body (3) has a size of from 45° to 60°.

12. A fuel injection valve in accordance with claim 1, in which the restoring force that presses the valve member (5) against the valve seat (9) is generated by two valve springs, of which a first valve spring (15) acts constantly upon the valve member (5), and a second valve spring does not engage the valve member (5) until after a preliminary stroke motion of the valve member (5) in the opening direction has been traversed.

* * * * *